United States Patent [19]

Sweet et al.

[11] Patent Number: 4,837,920

[45] Date of Patent: Jun. 13, 1989

[54] SLIP RING ASSEMBLY AND METHOD OF MANUFACTURE

[75] Inventors: David B. Sweet, Hartville; James T. Hindel, Munroe Falls, both of Ohio

[73] Assignee: The BFGoodrich Company, Akron, Ohio

[21] Appl. No.: 536,031

[22] Filed: Sep. 26, 1983

[51] Int. Cl.[4] ..... H01R 43/06

[52] U.S. Cl. ..... 29/597; 264/258; 264/277

[58] Field of Search ..... 29/597; 156/245, 307.1, 156/307.3, 307.7, 330; 264/137, 258, 277; 310/232, 235

[56] References Cited

U.S. PATENT DOCUMENTS

| | | | |
|---|---|---|---|
| 2,634,342 | 4/1953 | Baechler, Jr. et al. | 29/597 X |
| 3,430,338 | 3/1969 | Flaherty | 29/597 X |
| 4,386,989 | 6/1983 | Aubry | 156/307.7 X |

*Primary Examiner*—Timothy V. Eley
*Attorney, Agent, or Firm*—Joseph Januszkiewicz

[57] ABSTRACT

A slip ring assembly having a slip ring holder made of a composite dielectric material reinforced by layers of fabric is molded in one case with the slip rings positioned in the mold and in a second case grooves are machined in the holder for receiving the slip rings. The holder has at least one annular flange for mounting the assembly on a rotating part such as a spinner bulkhead of an aircraft propeller assembly. Slip rings are adhered to the composite material of the holder as a result of molding or use of an adhesive where the grooves are machined in the holder. Metallic wire connections can be fastened to the slip rings by welding which also serve to hold the slip rings in the grooves of the holder. The wire connections may have pins for receiving mating receptacles. Openings in the ends of the metallic wire connections are suitable for crimping wire connectors to the de-icers or de-icer terminals.

9 Claims, 2 Drawing Sheets

SLIP RING ASSEMBLY AND METHOD OF MANUFACTURE

BACKGROUND OF THE INVENTION

This invention relates to a slip ring assembly and especially to a slip ring assembly for electrothermal propeller de-icing systems. Heretofore copper slip rings have been mounted ing rooves of a machined aluminum base made from wrought aluminum plate or an aluminum casting. The copper slip rings have been attached to the aluminum base by dielectric spacers of a suitable plastic and a poured epoxy filler which acts as an additional dielectric between the rings and as an additional means of securing the rings tot he base. It has been necessary to machine the copper slip rings after mounting on the base to obtain a surface which is flat and parallel with the mounting surface on the base so that contact may be maintained with the brushes during rotation for transfer of electrical energy in the most efficient manner. Problems have occurred with distortion of the aluminum base during machining of the rings. The manufacturing process involving pouring of epoxy medium around the copper slip rings has been costly because the aluminum base had to be specially treated and the slip rings cleaned with great care to provide adequate adhesion and positioning of the slip rings. The curing of the epoxy in an oven and machining of the rings after removal from the oven has increased the manufacturing costs. Also, problems have occurred with distortion of the aluminum base during the curing process. Problems have also occurred with the electrical connections due to cold solder joints.

SUMMARY OF THE INVENTION

The present invention provides a slip ring assembly in which the base member is of a dielectric material and the slip rings are mounted in a position coaxial and concentric with the axis of rotation of the base member. Mounting portions of the base member extend radially from the slip rings for mounting the base member on a rotating part and the electrical connections to the slip rings extend through the base member of dielectric material and contribute to the mounting of the slip rings on the base member. The wire connections may be of a crimped type for eliminating solder connections. The electrical connections may also be of pin and mating connector type. By molding the base member of a composite material which may be reinforced by cross-plied woven fabric, the base member is not easily distorted during installation or during machining when necessary.

In accordance with one aspect of the invention there is provided a slip ring assembly comprising a base member of dielectric material rotatable about an axis of rotation, at least two slip rings coaxial with the axis of rotation of the base member mounted on and fastened to a surface of the base member, a mounting portion of the base member extending radially from the slip rings for mounting the base member on a part rotating about the axis of rotation and electrical connections extending from the slip rings through the base member and means for attaching electrical conduits to distal ends of the connections.

In accordance with another aspect of the invention there is provided a method of making a slip ring assembly having slip rings mounted on a base member rotatable about an axis comprising (a) positioning layers of resin impregnated reinforcing fabric in overlapping relation to form the base member, (b) curing the layers of resin impregnated reinforcing fabric of the base member at elevated temperatures to provide a unitary body of dielectric composite material, (c) positioning the slip rings on the base member in concentric relationship, (d) adhering the slip rings to the base member.

DETAILED DESCRIPTION

Figure 1:
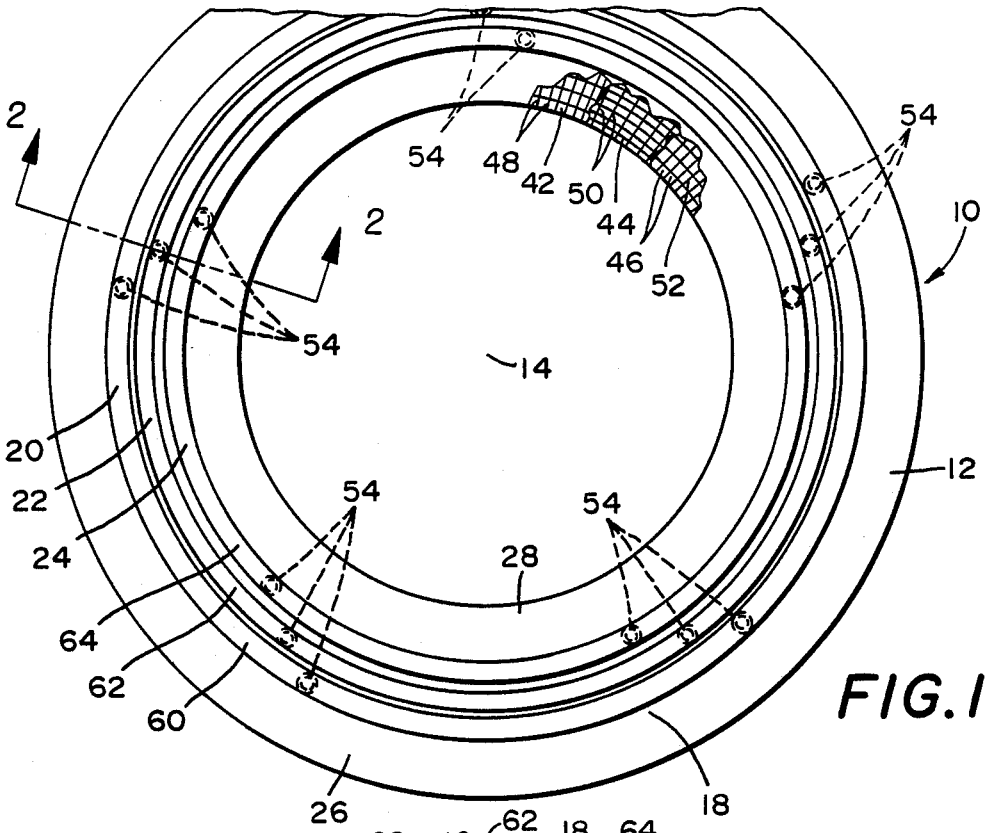
FIG. 1 is a plan view of a slip ring assembly embodying the invention with parts being broken away to show the disposition of the cords in the layers of reinforcing fabric.
Figure 2:
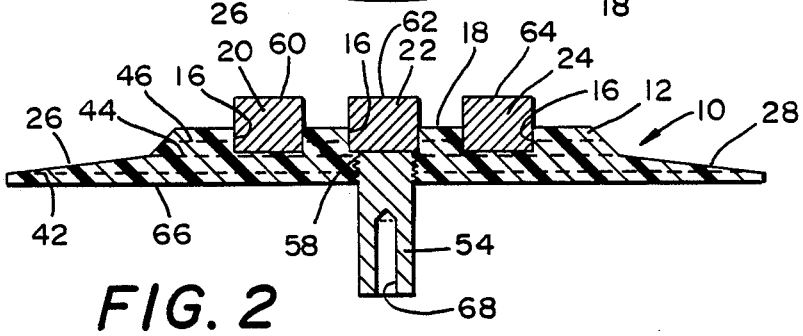
FIG. 2 is a section taken along the lines 2—2 of FIG. 1.
Figure 3:
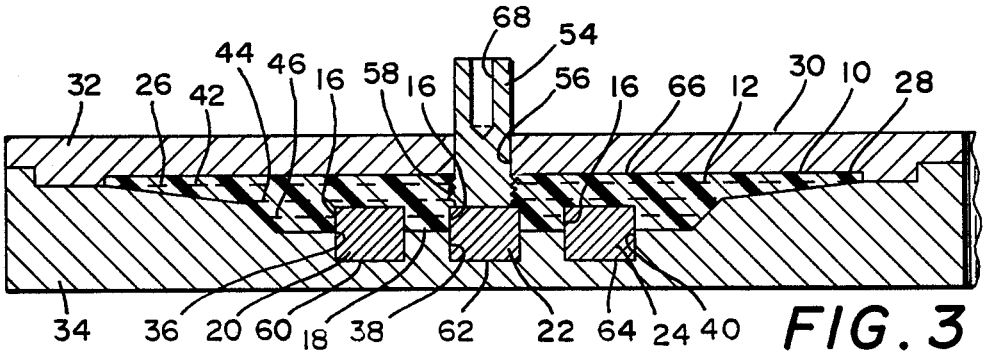
FIG. 3 is a fragmentary sectional view of the slip ring assembly of FIGS. 1 and 2 as molded in a two-piece mold.

Referring to FIGS. 1 through 3, a slip ring assembly 10 is shown having a base member such as slip ring holder 12 which is generally circular and rotatable about an axis of rotation 14. The slip ring holder 12 has concentric grooves 16 in a front surface 18 for positioning of slip rings 20, 22 and 24. Mounting portions such as flanges 26 and 28 extend radially from the slip rings 20, 22 and 24 for mounting the slip ring holder 12 on a rotating part such as the spinner bulkhead of a propeller assembly (not shown).

In the embodiment shown in FIGS. 1, 2 and 3, the slip ring holder 12 is made of a thermosetting plastic composite material which is molded in a suitable mold such as two-piece mold 30 having an upper half 32 and a lower half 34. Grooves 36, 38 and 40 which are concentric with the axis of rotation 14 of the slip ring holder 12 are provided in the lower half 34 of the mold 30 for positioning the slip rings 20, 22 and 24. The slip ring holder 12 is a reinforced body of composite material which may include resin impregnated layers of fabric 42, 44 and 46 laid up in overlapping relation and placed in the mold 30 around the slip rings 20, 22 and 24. Preferably the resin is an epoxy resin and the layers 42, 44 and 46 are of a woven glass cloth having warp cords 48, 50 and 52, respectively. The layers 42, 44 and 46 are cross-plied with the cords 50 of layer 44 extending in a different direction at an angle of about 90 degrees to the direction of the warp cords 48 and 52 of the layers 42 and 46.

The slip rings 20, 22 and 24 have metallic wire connections such as studs 54 fastened as by welding to the slip rings. As shown in FIG. 3, the upper half 32 of the mold 30 has apertures 56 through which the studs 54 extend. Grooved surfaces such as threads 58 into which the resin can flow during molding may be provided on the studs 54 at positions which after molding are within the slip ring holder 12 for retaining the slip rings 20, 22 and 24 in the grooves 16.

The slip ring assembly 10 is molded in the mold 30 at elevated temperatures and pressures. A suitable material is a NEMA grade G-10 glass cloth and an epoxy resin composite having the following physical and electrical properties in accordance with ASTM method D229: Rockwell "M" hardness of 115, Tensile strength with grain - 50,000 psi (3,515.4 Kg/cm$^2$), Volume Resistivity $6\times10^6$ megohm-cm, Surface Resistivity $1\times10^6$ megohms.

During molding, the copper material of the slip rings 20, 22 and 24 is bonded to the slip ring holder 12. When the assembly 10 is removed from the mold 30, the slip rings 20, 22 and 24 will be precisely positioned in a concentric relationship with the axis of rotation 14. Contact surfaces 60, 62 and 64 of the rings 20, 22 and 24, respectively, will be flat and parallel with mounting surface 66 of the slip ring holder 12 so that during operation contact is maintained with the brushes during rotation and the transfer of electrical energy is accomplished in the most efficient manner.

The studs 54 have openings 68 at the ends outside the holder 12 for receiving connecting wires which may then be crimped within the walls of the studs to provide an electrical connection between the slip rings 20, 22 and 24 and the de-icer or wire harness. The direct connection may also eliminate the need for a separate terminal strip. The slip ring holder 12 of this embodiment may be of the same composite material as the spinner bulkhead so that the holder may be munted on the spinner bulkhead by bonding to the composite material of the bulkhead.

Figure 4:
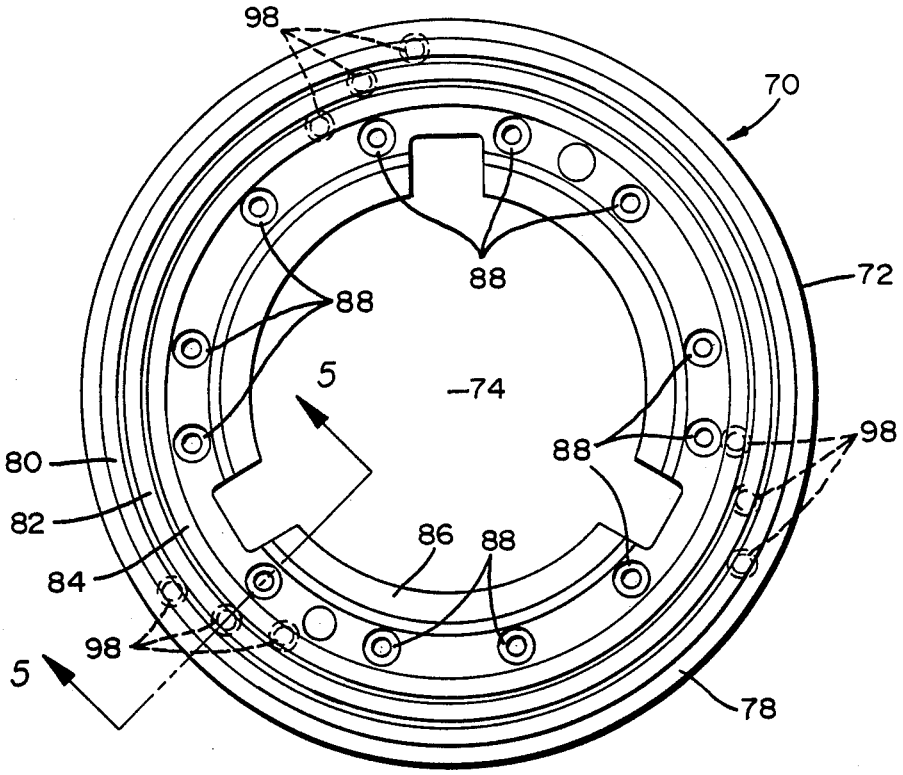
FIG. 4 is a plan view of a modified slip ring assembly embodying the invention.
Figure 5:
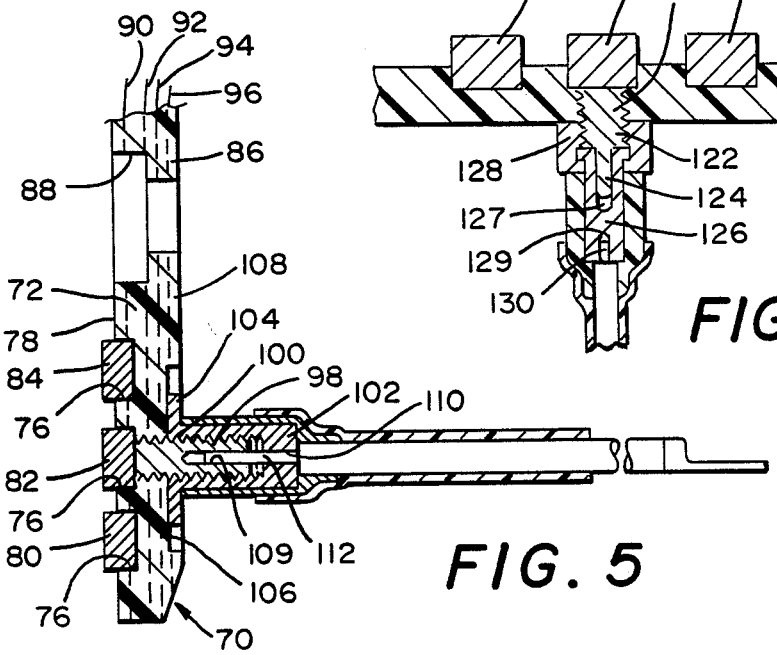
FIG. 5 is an enlarged fragmentary sectional view taken along line 5—5 in FIG. 4.

Referring to FIGS. 4 and 5, a modified slip ring assembly 70 embodying the invention is shown in which a base member such as slip ring holder 72 is rotatable about an axis of rotation 74 and has concentric grooves 76 machined in a front surface 78 for receiving slip rings 80, 82 and 84. The slip ring holder 72 may have a mounting portion such as flange 86 extending radially inward from the slip rings 80, 82 and 84 for mounting the holder on a rotating part such as the spinner bulkhead of an aircraft propeller assembly (not shown). Bolt holes 88 drilled in the holder 72 may be provided for bolting the holder to the spinner bulkhead.

The slip ring holder 72 may be molded of the same composite material described hereinabvoe for the embodiment of FIG. 1 with layers of reinforcing fabric 90, 92, 94 and 96 impregnated with a resin and molded under elevated temperatures and pressures as described for the slip ring holder 12 of the embodiment shown in FIGS. 1, 2 and 3. The slip rings 80, 82 and 84 are mounted in the grooves 76 and adhered thereto by a suitable adhesive and also by metallic fasteners such as threaded studs 98 welded to the slip rings and extending through drilled holes 100 in the holder 72. Flanged barrel members 102 are threaded over the studs 98 and have flanges 104 for engagement with chamfered insets 106 in a mounting surface 108 of the holder 72. The studs 98 and barrel members 102 are part of metallic wire connections for the slip ring assembly 70. As shown in FIG. 5, each of the studs 97 has an opening 109 and each of the barrel members 102 has an opening 110 for receiving a wire 112 which is crimped into the barrel member and stud to provide a reliable electrical connection between the slip rings 80, 82 and 84 and the de-icer or wire harness.

Figure 6:
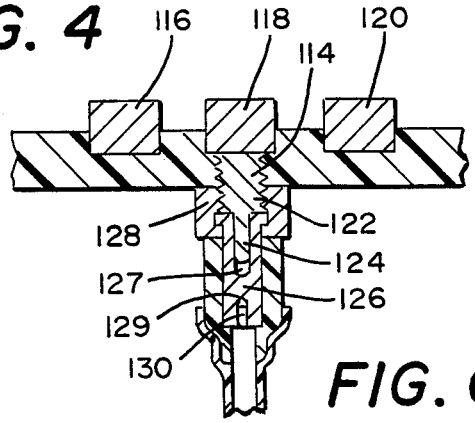
FIG. 6 is a fragmentary sectional view like Fig 2 showing a modified electrical connection embodying the invention.

As shown in FIG. 6, an alternative connection may include a male pin connector 114 welded to each of slip rings 116, 118 and 120 with a threaded extension 122 and pin 124. A female pin receptacle 126 has an inner opening 127 for receiving the pin 124 and has a flanged nut 128 for threading on the threaded extension 122 of the male pin connector 114 for retaining the pin in mating engagement. The female pin receptacle 126 has an outer opening 129 for receiving a connecting wire 130 which may then be crimped within the walls of the receptacle to provide an electrical connection between the slip ring 118, shown in FIG. 6, and the de-icer.

With the construction set forth above, tests have shown that the slip ring assemblies 10 and 70 have sufficient strength to withstand the substantial radial and hoop stresses experiienced during rotation of the assemblies. There is approximately a 20 percent reduction in weight as compared to the assembly having a slip ring holder of aluminum and distortion due to maching is substantially eliminated. The electrical connections are also greatly improved and the bonding of the composite material of the slip ring holder 12 to the composite material of the spinner bulkhead is made possible.

The invention is capable of other modifications and adaptions by those having ordinary skill in the art and is more particularly defined by the appended claims.

We claim:

1. A method of making a slip ring assembly having slip rings mounted on a base member rotatable about an axis comprising (a) positioning layers of resin impregnated reinforcing fabric in overlapping relation to form said base member, (b) curing said layers of resin impregnated reinforcing fabric of said base member at elevated temperatures to provide a unitary body of dielectric composite material, (c) positioning said slip rings on said base member in concentric relationship, (d) adhering said slip rings to said base member.

2. The method of claim 1 wherein said reinforcing fabric is of glass cords and said resin is an epoxy resin.

3. The method of claim 1 including positioning said slip rings in concentric grooves in a mold and thence curing said base member in said mold.

4. The method of claim 1 including machining concentric grooves in said base member after curing of said base member, positioning said slip rings in said grooves and adhering said slip rings to said base member by an adhesive.

5. The method of claim 1 including welding studs to said slip rings to provide electrical connections.

6. The method of claim 5 including positioning said studs in said base member during curing providing flow of said resin into grooved surfaces on said studs to fasten said slip rings to said base member.

7. The method of making a slip ring assembly having slip rings mounted on a base member rotatable about an axis, comprising the steps of positioning a plurality of annular slip rings into a plurality of concentric recessed annular grooves in a mold, placing a plurality of layers of resin impregnated reinforcing fabric in overlapping relation in said mold to form a base member, and curing said layers of resin impregnated reinforcing fabric forming said base with said slip rings in place to form a unitary body of dielectric composite material in cooperative relationships with said concentrically spaced slip ring.

8. The method of making a slip ring assembly as set forth in claim 7 wherein said mold has studs extending through said base member into abutting contact with said slip rings prior to said curing.

9. The method of making a slip ring assembly as set forth in claim 8 wherein said studs have grooved surfaces along their periphery in said mold to facilitate the connecting of said studs to said slip ring assembly during curing.

* * * * *